United States Patent [19]

Bastenhof et al.

[11] 4,426,198

[45] Jan. 17, 1984

[54] FUEL-INJECTION PUMP FOR INTERNAL COMBUSTION ENGINE

[75] Inventors: Dirk Bastenhof, Eaubonne; Roger Brisson, Gonesse; Claude Bonniot, Paris, all of France

[73] Assignee: Societe d'Etudes de Thermiques S.E.M.T., St. Denis, France

[21] Appl. No.: 477,594

[22] Filed: Mar. 25, 1983

Related U.S. Application Data

[63] Continuation of Ser. No. 152,537, May 23, 1980, abandoned.

[30] Foreign Application Priority Data

May 28, 1979 [FR] France ..... 7913486
May 16, 1980 [FR] France ..... 8011046

[51] Int. Cl.[3] ..... F02M 59/38
[52] U.S. Cl. ..... 417/494; 123/299
[58] Field of Search ..... 417/493, 494; 123/299, 123/300

[56] References Cited

U.S. PATENT DOCUMENTS 2,306,364 12/1942 Skaredoff ..... 417/493
2,810,375 10/1957 Froehlich et al. ..... 417/494 X

FOREIGN PATENT DOCUMENTS 641575 8/1950 United Kingdom .

*Primary Examiner*—Leonard E. Smith
*Attorney, Agent, or Firm*—Kenyon and Kenyon

[57] ABSTRACT

A constant-stroke, variable by-pass, plunger-type, jerk pump for injecting fuel-oil into a working cylinder of an internal combustion engine, wherein the plunger comprises a passage-way opening at one end thereof into the working chamber of said plunger and adapted to communicate at its other end with at least one duct connected to the fuel supply and opening into the pump cylinder housing said plunger to temporarily cut off the fuel discharged from said chamber to the fuel injector during the upward stroke of the plunger towards its top dead center, the first fuel discharge phase enabling the fuel to be pre-injected into the engine cylinder whereas the second fuel discharge phase provides for the main injection of fuel thereinto.

6 Claims, 11 Drawing Figures

F1
-3-
V
VI
AM
PMH
D
C
B
A
R

FUEL-INJECTION PUMP FOR INTERNAL COMBUSTION ENGINE

This application is a continuation of application Ser. No. 152,537, filed May 23, 1980, now abandoned.

The invention relates to a fuel-injection pump for injecting fuel into a working or power cylinder of an internal combustion engine.

The invention is directed in particular to a constant-stroke, variable by-pass, plunger-type, fuel-injection jerk pump comprising a fuel receiving chamber defined within a cylindrical body or barrel within or formed by the pump casing or housing, and variable in volume through the displacement, within this barrel, of a piston-like plunger back and forth according to a reciprocating motion between a top dead center position and a bottom dead center position, this chamber being provided with at least one fuel inlet port connected to a fuel supply source at a relatively low pressure and which is closed or shut off by being covered by said plunger upon its upward stroke from its bottom dead center position towards its top dead center position so that the fuel may be discharged out of said chamber and delivered therefrom to an injector associated with an engine cylinder, said plunger comprising at least one helical edge or ramp at its periphery which meets endwise with an axially extending straight groove and with a circular groove connected by said straight groove to the inside space of said receiving chamber.

Fuel-oil injection pumps of such a construction, which are known in the prior state of the art, suffer from the inconvenience that the amount of fuel injected into an engine cylinder before ignition may become relatively large in case the ignition is substantially delayed by the combustion-supporting intake air being too cold or by the bad quality of the fuel. When ignition occurs at last, a large amount of fuel would be ignited thereby resulting in a great increase in pressure within the combustion chamber thus inducing high stresses within the component parts of the engine, such as the cylinder liner or jacket, in the crankshaft journal or bearing, and giving rise to fluid-tightness difficulties, for instance at the cylinder head gasket or sealing joint as well as to noise.

It is known that it is possible to remove such drawbacks by effecting a pre-injection prior to the main injection. By causing at first a small amount of pre-injection fuel to be ignited, the ignition of the main injection fuel which occurs practically without any ignition time lag, is thus secured. The pre-injection step however, such as it has been performed heretofore, requires complicated additional means which are difficult to be used.

The object of the invention is to provide an injection pump adapted to carry out the pre-injection step owing to a suitable structural configuration of the injection pump of the kind referred to hereinabove.

To accomplish this object, the piston-like plunger of the injection pump comprises a passage-way opening at one end thereof into said fuel-receiving chamber and adapted to communicate through its other end with at least one duct opening into the inside space of the barrel or hollow cylindrical body and leading or extending from said fuel supply source so as to cut off at a predetermined time and for a predetermined duration the fuel discharge out of and from said chamber to the injector during the displacement or stroke of the plunger towards its top dead center, whereby the first fuel delivery stage provides for a pre-injection of fuel into the engine cylinder whereas the second fuel delivery stage performs the main fuel injection.

According to an advantageous characterizing feature of the invention, the plunger comprises, underneath said first circular groove, a second peripheral groove communicating with the first circular groove, and the injection pump barrel or body comprises at least one aforesaid inlet duct located below said inlet ports and which may be closed or shut off by being covered by the peripheral surface of the plunger, the inlet duct and said second peripheral groove being arranged so that said peripheral groove may register in confronting relationship with said duct at a predetermined moment after said inlet ports have been closed or covered by said plunger during the discharge stroke of the latter towards its top dead center.

The injection pump according to the invention moreover comprises a fuel accumulating or storage device for varying the amount of pre-injection fuel without affecting the beginning or start of the main injection.

The invention will be better understood and further objects, characterizing features, details and advantages thereof will appear more clearly as the following explanatory description proceeds with reference to the accompanying diagrammatic drawings given by way of non limiting examples only illustrating two specific, presently preferred embodiments of the invention and wherein.

Figures 1, 2, 3, 4, 5, 6:
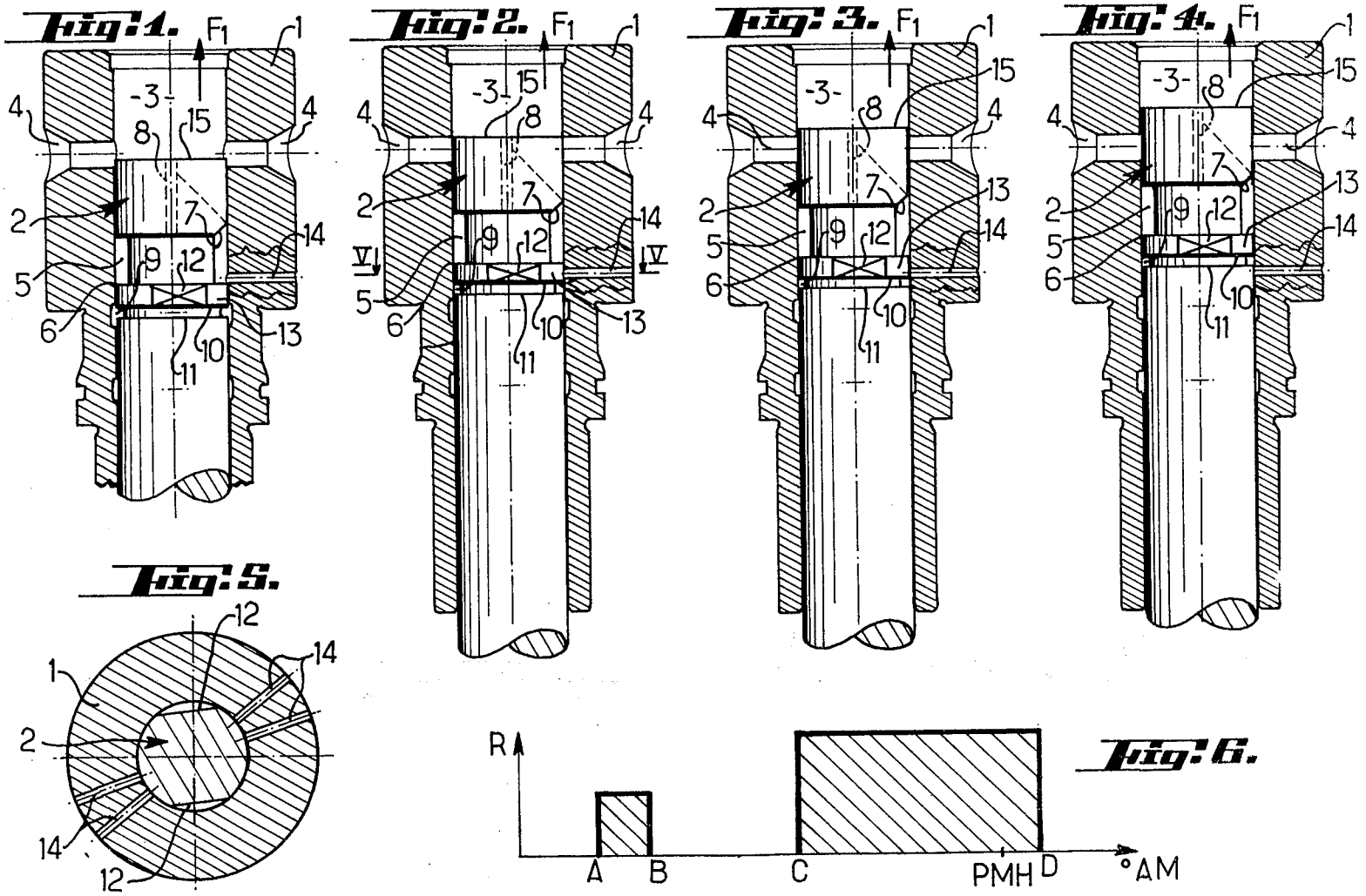
FIGS. 1 to 4 are views shown in longitudinal section of a first embodiment of an injection pump according to the invention and illustrating specific steps of the operation of the pump.
FIG. 5 is a view in cross-section taken upon the line V—V of FIG. 2.
FIG. 6 is a chart or diagram showing the phases of fuel discharge out of and from the chamber of the injection pump in accordance with the position of the power piston in an engine cylinder, as plotted against the angular position of the crankshaft.

The invention pump shown in FIGS. 1 to 5 comprises a cylindrical body or barrel 1 and a piston-like plunger 2 movably fitted into this barrel 1 for reciprocating linear motion back and forth between a bottom dead center position and a top dead center position under the action of a control cam (not shown) operatively connected to a shaft driven by the engine.

Within the barrel 1 and above the plunger 2 is defined a fuel-intake chamber 3 into which are opening fuel inlet ports 4. These ports are located at such a level that they enable the chamber 3 to be filled with fuel when the plunger assumes its bottom dead center position.

At the upper part (not shown) of the chamber is provided a fuel discharge port for delivering fuel in the direction of the arrow F1 towards an injector associated with a power-generating or working cylinder of an internal combustion engine. This discharge port may be closed by a fuel delivery valve or like member as known per se.

The plunger 2 is formed with a first circular groove 5 defined at its lower portion by a plane or circular edge 6 and at its upper portion by a helical edge 7 forming a helical ramp and leading to a straight groove 8 which extends in parallel relation to the center line axis of the plunger. This straight groove provides a permanent communication between the intake chamber 3 and the circular groove 5. The plunger and barrel construction described until now is known.

According to the invention, the plunger 2 is formed with a second circular groove 9 defined in the examplary embodiment shown by a circular or plane edge 10 at its upper part and by a circular or plane edge 11 at its lower part. This second groove 9 communicates with the first groove 5 through axial passage-ways provided in the examplary embodiment shown by two flattenings 12 formed on the land or collar portion 13 which is defined between both grooves 5 and 9. It should be noted that the edges 6, 7, 10 and 11 are each one shaped as a sharp right angle of 90°.

As appearing from the drawings, fuel feed or inlet ducts 14 extend through the wall of the pump barrel 1 at a predetermined distance from and below the fuel inlet ports 4. The ducts 14 and the ports 4 are connected to a fuel supply source of relatively low pressure.

The spacing or distance, in the axial direction of the plunger, between the fuel inlet ports 4 and the fuel inlet or feed ducts 14, the distance or spacing between the top end face 15 of the plunger 2 on the one hand and the edges of both grooves 5 and 9 on the other hand as well as the axial height of the land or collar 13 and the width of the second groove 9 are so selected as to provide for the specific operating steps of the pump shown on FIGS. 1 to 4.

In the position of the plunger shown on FIG. 1, the intake chamber 3 communicates with the inlet ports 4 thereby enabling the chamber 3 to be filled with fuel. When moving upwards, i.e. towards its top dead center position, the plunger 2 would reach the position shown in FIG. 2 in which it begins to cover or close off the inlet ports 4. Since the land or collar 13 is located in front of the inlet ducts 14 and covers or shuts off the latter, there is no longer any communication between chamber 3 and a low-pressure fuel feed line. This would be the start or beginning of fuel discharge towards the injector in the direction of the arrow F1. This fuel discharge beginning is denoted by the letter A in FIG. 6 on which the fuel discharge R is plotted in ordinates and the corresponding angular displacement or rotation of the crankshaft AM is plotted in abscissae (the top dead center position being indicated by PMH).

Keeping moving on its upward stroke, the plunger 2 reaches the position shown in FIG. 3 wherein the upper edge 10 of the second circular groove 9 is on a level with the lower edge of the openings of the inlet ducts 14, thereby causing these ducts 14 and the groove 9 as well as the groove 5 and the groove 8 through the agency of the flattenings 12 to communicate with chamber 3. This results in a sudden pressure drop within the chamber 3. The fuel discharge is stopped or discontinued although the plunger keeps moving on its upward stroke. This condition is denoted in FIG. 6 by the letter B. This communication and the low pressure resulting therefrom inside of the chamber 3 will remain until the plunger reaches the position shown in FIG. 4, wherein the lower edge 11 of the groove 9 is on a level or registering with the upper edge of the inlet ducts 14. The latter are covered or shut off by the cylindrical side surface of the plunger following the groove 9. In this position the inlet ports 4 are still covered or closed off. With the chamber 3 being thus separated from or cut off the low pressure ports and ducts 4, 14, the fuel pressure within the chamber will increase and the delivery of fuel towards the injector will be resumed as denoted by the letter C in FIG. 6. The discharge will end at D when the helical ramp 7 registers in confronting relationship with an inlet or spill port 4. The injection is faster between C and D than between A and B because the speed of the plunger-actuating cam is still small between A and B since it occurs relatively at the beginning of the upward stroke of the plunger.

The position of the bottom dead center of the plunger 2 with respect to the movement of the power-generating piston in the working cylinder of the engine is so selected that the start A of the first phase of fuel injection into the engine cylinder be advanced enough with respect to the top dead center of the piston in said engine cylinder so that this first injection may form a pre-injection step providing for the ignition, within the combustion chamber of an engine cylinder, of the amount of main injection fuel substantially without any time lag or delay in ignition. The beginning of the pre-injection could for instance take place at a moment corresponding to an angle of rotation of about −30° of the crankshaft before the top dead center of the engine piston and the main injection could be initiated at an angle of about −15°. These values are given of course by way of illustrative example only.

It has been found that the effect of the pre-injection varies in accordance with the rotary speed of the engine. At relatively low speeds, the illustration of the first discharge phase, i.e. of the pre-injection discharge, plotted as a rectangle according to FIG. 6, would correspond to phenomena which are actually occurring.

At higher speeds, however, the discharge and the pre-injection against time would rather assume a bell-shaped trend, owing to the fact that the building up of the relatively high pressure inside of the chamber 3 during the fuel discharge out of the chamber and the pressure drop within the chamber in view of it being put into communication with the inlet ducts 14, would require a certain length of time, since the inlet ports 4 and the inlet ducts 14 have cross-sectional passage-way areas of limited values, respectively.

Thus at high rotary speeds, the pressure will increase within the chamber prior to the covering of the inlet ports 4, and the uncovering of the inlet ducts 14 by the land 13 will not result forthwith in the pressure drop in said chamber. Therefore, a fuel discharge and an injection effect will take place even at high rotary speed of the engine when the duct openings 14 are uncovered before the inlet ports are covered. This fuel discharge out of the chamber through a "throttling" effect may occur for instance with a plunger formed with a notch in its top end face 15 and operating at an angular position wherein the notch is registering in confronting relationship with the inlet ports 4, thereby delaying the closing or covering of these ports. If the notch is deep enough, the groove 9 may register in confronting relationship with the duct openings 14 before the covering or closing of the inlet ducts. At low speed, the discharge phase A-B (FIG. 6) would not take place. At full speed however a discharge and a pre-injection will yet take place, due to the throttling effect.

In the example described and shown, the upper and lower edges 10, 11 of the second groove 9 are plane and circular. It is however possible to shape at least one edge, for instance the upper edge, at least partially as a helical ramp. This would make it possible to vary the moment of the end of the pre-injection discharge (B in FIG. 6) through rotation of the plunger 2 about its longitudinal center line axis. A suitable configuration of the lower edge of the groove 9 would make it possible to change or alter the beginning of the main injection discharge step (C).

The embodiment shown in FIGS. 2 to 5 comprises a circular groove 9 and twice two inlet ducts 14 and this with the view to reducing the height of the groove 9 and the diameters of said ducts 14, respectively, because these two dimensions will determine the distance or spacing between B and C in FIG. 6, i.e. the moment of the pre-injection with respect to the main injection on the one hand and the lift or travel of the cam corresponding to that period of time on the other hand. These measures make it possible to decrease the length of the inoperative portion, i.e. without any discharge, of the plunger stroke, to make the start of the main injection discharge earlier and/or to delay the ending of the pre-injection discharge.

Figure 7:
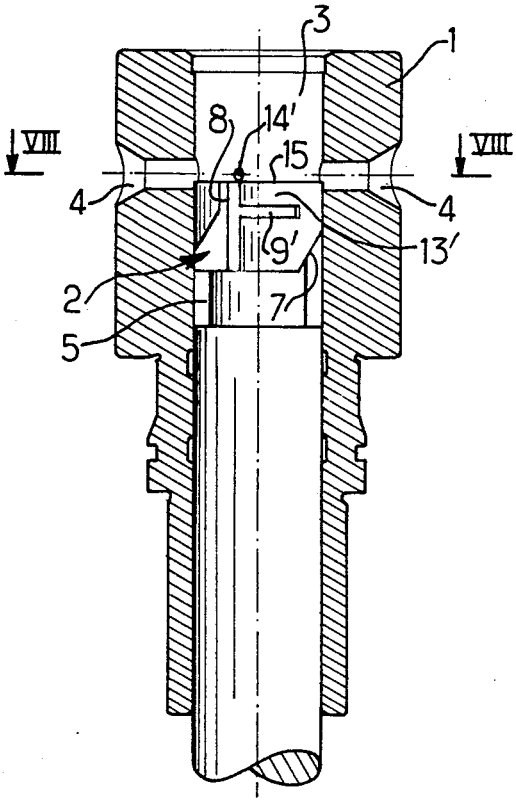
FIG. 7 is a view in longitudinal section showing a second embodiment of an injection pump according to the invention.
Figure 8:
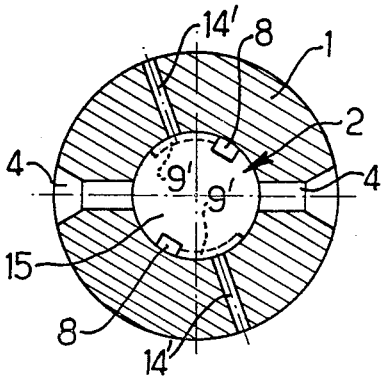
FIG. 8 is a view in cross-section taken upon the line VIII—VIII of FIG. 7.

FIGS. 7 and 8 illustrate another embodiment of the injection pump according to the invention, wherein the inlet ducts 14'—which are two in number in the examplary embodiment shown—are located approximately on the same level as the inlet ports 4. Two grooves 9' the operation of which corresponds to that of the circular groove 9 of the first embodiment are formed in the peripheral surface of the plunger at a predetermined distance from the top end face 15 of the plunger and in substantially parallel relation thereto.

As clearly appearing from FIGS. 7 and 8, each groove 9' opens at one end thereof into an upright or vertical groove 8 and thus permanently communicates with the inside of the intake chamber 3. According to an alternative embodiment, each groove could be in communication with this chamber through both of its ends.

The operation of this embodiment is the same in terms of principles as that of the embodiment shown in FIGS. 1 to 4. The pre-injection discharge step will start when the inlet ports 4 are covered by the plunger. The inlet duct openings 14 are covered by that portion of the peripheral surface 13' of the plunger which lies above the grooves 9'. This discharge step will end at the moment when the grooves 9' are caused to register in confronting relationship with the duct openings 14'. The main injection discharge will begin after the covering of the duct openings 14' by the peripheral surface of the plunger located beneath the grooves 9' and will end when the ramps 7 uncovers the inlet or spill ports 4.

Figure 9:
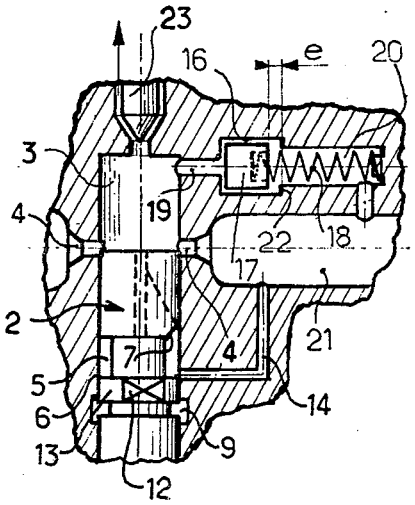
FIG. 9 is a fragmentary sectional diagrammatic view showing the accumulator device according to the invention.

The injection pump according to the present invention also comprises means for varying the beginning of the pre-injection discharge step. These means consist of an accumulator or storage device. According to the diagrammatic showing of FIG. 9, the accumulator comprises an accumulating chamber 16 wherein is fitted a piston 17 movable against the opposing action of a biasing or return spring 18. The chamber 16 communicates permanently with the intake chamber 3 of the injection pump through a passage-way 19 which opens into the chamber 3 at a level positioned above the top dead center of the plunger 2. The rear part 20 of the chamber 16, which accommodates the spring 18, is in permanent communication with a space 21 from which extend the inlet ports and ducts 14. Thereby is ensured that a relatively low pressure acts upon the rear face of the piston 17. The stroke of the piston 17 is restricted by a stop 22 consisting for instance of a shoulder of the wall of the chamber 16. The piston 17 is displaceable over a length e. The stop 22 is shaped as a fluid-tight seat to provide a fluid-tight barrier between the chamber 16 and the chamber portion 20 containing the spring 18, when the piston is pushed or driven against and in engagement with the stop under the action of the high pressure which prevails within the chamber 3 of the pump and the chamber 16 when fuel is delivered towards the injector.

This accumulator operates as follows:

When after the inlet ports 4 have been covered, the plunger 2 keeps moving on its upward stroke, the pressure within the receiving chamber 3 will increase but slowly or smoothly because the decrease in volume of the receiving chamber 3 is compensated for by an increase in the volume of the accumulating chamber 16 owing to the fact that the piston 17 could move back under the action of the pressure increase. Therefore, the pressure which is required to open the delivery valve 23 may build up only after the piston 17 has come into fluid-tight engagement with its stop-like seat 22. This means that the point A in FIG. 6 is shifted towards the point B and that the amount of discharged pre-injection fuel will decrease. On the other hand the discontinuance of the discharge at point B is independent of the accumulator and determined only by the putting in communication of the additional duct openings 14 and of the discharge-discontinuing groove 9. Although the pressure within the chamber 3 would drop, it would however remain, in view of the plunger keeping moving on its upward stroke, at a value large enough to retain the accumulator piston 17 on its seat 22.

This means that the accumulator would exert no action on the beginning of the main injection discharge but makes it possible to vary the beginning of the pre-injection discharge (point A in FIG. 6) and thereby the amount of pre-injection fuel.

Figure 10:
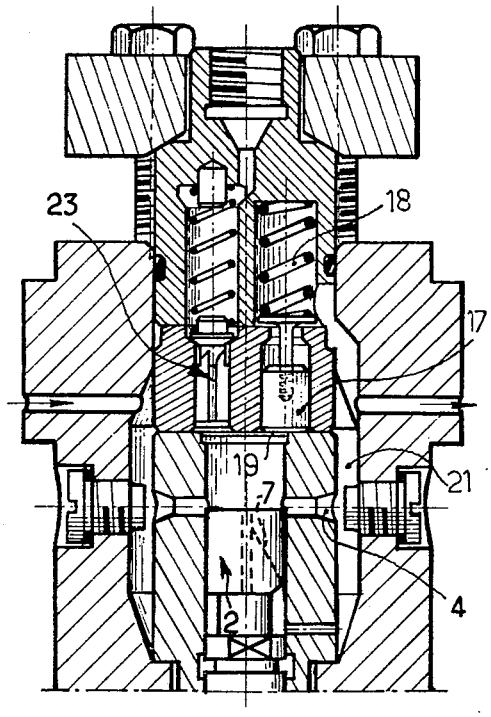
FIGS. 10 and 11 illustrate two practical embodiments of an accumulator device according to the invention.
Figure 11:
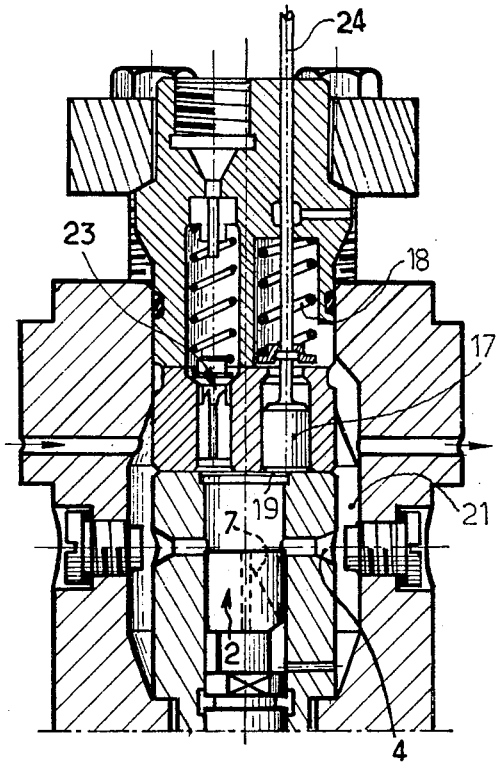

FIGS. 10 and 11 show two embodiments of the accumulator according to the invention. In both instances the accumulator is arranged beside the device forming the delivery member or valve 23 above the intake chamber 3 of the injection pump. Thus the accumulator is well incorporated into or self-contained within the pump structure.

The accumulator shown in FIG. 11 is designed to enable the beginning of the pre-injection discharge to be adjusted from the outside. For this purpose, a rod 24 is secured to the rear face of the piston 17. The free end of said rod extends out or projects outside of the pump. The rod 24 may be actuated or controlled from the outside of the pump, whereby the final position of the piston 17 may be easily varied. It is also possible to put the pre-injection out of service.

It should be understood that the invention is not at all limited to the embodiments described and shown which have been given by way of illustrative examples only. In particular it comprises all the means constituting technical equivalents of the means described as well as their combinations if same are carried out according to its gist and used within the scope of the appended claims.

What is claimed is:

1. An injection pump for injecting fuel into a cylinder of an internal combustion engine, the pump comprising a fuel receiving chamber defined within a cylindrical body, a plunger slidably disposed within an inside space of said body for reciprocating linear motion between a bottom dead center position and a top dead center position, said chamber being provided with fuel inlet ports connected to a fuel supply source at a relatively low pressure and which are adapted to be covered by said plunger during its displacement towards its top dead center to cause fuel to be discharged out of said chamber towards the injector associated with said engine cylinder, said plunger having a head formed with at least one helical ramp on its periphery and a passageway opening into said chamber and adapted to communicate with at least one duct connected to said fuel supply source and opening into the inside space of said body in which said plunger is disposed, for interrupting the fuel discharge out of said chamber towards said injector during the displacement of said plunger towards its top dead center, such that the fuel discharge is separated into a first discharge phase providing a pre-injection of fuel into said engine cylinder and a second phase providing a main fuel injection, wherein the injection pump further comprises an accumulator device including an accumulating chamber which communicates permanently with said fuel receiving chamber and has a volume variable by a piston fitted into said accumulating chamber and movable against a return spring under the action of the pressure in the fuel receiving chamber, the stroke of said piston being limited by a stop forming a fluid-tight seat, said piston being moved against said seat by pressure developed during the first discharge phase and retained on its seat during discharge interruption under the effect of a pressure in the receiving chamber produced during said discharge interruption by said plunger continuing its displacement towards its top dead center, whereby the start of the pre-injection is delayed without affecting the start of the main fuel injection.

2. An injection pump for injecting fuel into a cylinder of an internal combustion engine, the pump comprising a fuel receiving chamber defined within a cylindrical body, a plunger slidably disposed within an inside space of said body for reciprocating linear motion between a bottom dead center position and a top dead center position, said chamber being provided with fuel inlet ports connected to a fuel supply source at a relatively low pressure and which are adapted to be covered by said plunger during its displacement towards its top dead center to cause fuel to be discharged out of said chamber towards the injector associated with said engine cylinder, said plunger having a head formed with at least one helical ramp on its periphery and a passageway opening into said chamber, the passageway including a groove extending in the peripheral surface of said plunger substantially perpendicularly to the axial direction of said plunger, and inlet duct means being provided in said body connected to a low pressure fuel supply source such as said fuel supply source to which said inlet ports are connected and opening into the inside space of said body in which said plunger is disposed, such that the peripheral surface of said plunger covers said inlet duct means during part of the discharge stroke of said plunger to its top dead center, said inlet duct means being arranged to register in confronting relationship with said groove at a predetermined axial displacement after said inlet ports have been covered by said plunger during its discharge stroke to discontinue during the period of such registration the fuel discharge out of said chamber towards said injector, such that the fuel discharge is separated into a first discharge phase providing a pre-injection of fuel into said engine cylinder and a second phase providing a main fuel injection, said inlet duct means having a predetermined cross section, wherein the improvement comprises said inlet duct means including more than two individual ducts each having a small diameter, such that the sum of the cross sections of the individual ducts is equal to said predetermined cross section, for reducing the period of time of discontinued fuel discharge, the injection pump further comprising a fuel accumulator device including an accumulating chamber which communicates permanently with said intake chamber and has a volume variable by a piston fitted into said accumulating chamber and movable against a return spring under the action of the pressure in the receiving chamber, the stroke of said piston limited by a stop forming a fluid-tight seat, said piston being moved against said seat by pressure developed during the first fuel discharge phase and retained on its seat during discharge discontinuance under the effect of the pressure in the receiving chamber produced by the plunger continuing its displacement towards its top dead center, whereby the pre-injection of fuel is delayed without affecting the start of the main fuel injection.

3. An injection pump according to claim 2, wherein that portion of said accumulating chamber which contains said return spring is in communication with that space from which extend said fuel inlet ports.

4. An injection pump according to claim 3, wherein said piston has substantially the same diameter as that of said accmulating chamber and a rod is secured to the rear end face of said piston whereas the free end of said rod projects outside of the pump structure for adjustably determining the length of the piston stroke.

5. An injection pump according to claim 2, wherein the length of the stroke of said piston located within said accumulating chamber is variable through variation of the position of said stop.

6. An injection pump according to claim 5, further comprising means for varying the position of said stop from the outside of said pump.

* * * * *